United States Patent [19]

Nixdorff

[11] 3,958,709

[45] May 25, 1976

[54] CONTAINER SAFETY CLOSURE SYSTEM

[75] Inventor: Frank S. Nixdorff, Baltimore, Md.

[73] Assignee: Anchor Hocking Corporation, Lancaster, Ohio

[22] Filed: Nov. 11, 1974

[21] Appl. No.: 522,619

[52] U.S. Cl. ..... 215/221; 215/216

[51] Int. Cl.[2] ..... B65D 55/02; B65D 85/56; H61J 1/00

[58] Field of Search ..... 215/9, 216, 221

[56] References Cited

UNITED STATES PATENTS

| | | | |
|---|---|---|---|
| 3,567,057 | 3/1971 | Landen | 215/221 |
| 3,744,655 | 7/1973 | Nixdorff | 215/216 |
| 3,884,379 | 4/1975 | Landen | 215/221 |

*Primary Examiner*—George T. Hall
*Attorney, Agent, or Firm*—Connolly and Hutz

[57] ABSTRACT

A safety closure system includes a cap removably mounted on the neck of a container and prevented from undesired opening by means of a locking ring mounted on the container neck and which locking ring has means such as a tooth engaged with complementary locking means such as notches on the cap. The cap and locking ring also contain positioning means to orient the ring with respect to the cap so as to assure proper engagement of the ring locking means with the cap locking means.

23 Claims, 15 Drawing Figures

CONTAINER SAFETY CLOSURE SYSTEM

BACKGROUND OF THE INVENTION

There is an ever increasing need for effective safety closures such as closures which prevent accidental opening of a container as by children. A number of approaches in the prior art has been taken. Exemplary of these are U.S. Pat. Nos. 2,980,275; 3,019,931 and 3,567,057. An arrangement which has met with warm acceptance is disclosed in U.S. Pat. No. 3,744,655. In that patent the neck is provided with a locking ring which has thereon a hinged tab carrying a locking tooth for engagement with notches in the cap. To disengage the locking tooth the tab is depressed so that the cap can be unscrewed in a conventional manner. A further arrangement which incorporates the principles of U.S. Pat. No. 3,744,655 is to provide a pair of oppositely disposed tabs on the locking ring with the locking teeth, however, being not quite 180° apart. This further arrangement has the obvious deficiency in its removal operation since it requires the locking teeth on both tabs to be manipulated out of engagement with the cap notches while the cap itself is being unscrewed.

While the hinged tab arrangement of U.S. Pat. No. 3,744,655 has been successful, it is possible that occasionally during assembly of the cap on the ring, the locking tooth will not be exactly registered in the desired position with respect to the notches in the cap. For example the cap notches contain slanted faces and the notches terminate in an apex. The ring locking tooth is similarly shaped and ideally should fit within the notch at the apex. If, however, during assembly the tooth abuts against the slanted notch wall rather than fitting in the apex there is a tendency to urge the hinged tab downwardly with a notch apex. Where on occasion the locking tooth is not positioned in its ideal location with respect to the cap notches, this improper positioning may be maintained over a long period of time such as while the container is in transit and is being stored prior to sale. When the container is subsequently used by removing the cap, the tab might tend to return only to the position it had during the long period of storage whereupon it might not register completely with the apex of the notch even if disposed at the apex. Under such conditions the system would not function as an effective safety closure. This problem can be avoided by using a material which has proper "memory" characteristics. For example U.S. Pat. No. 3,744,655 discloses the use of a polycarbonate or Lexan (Reg. T.M. of G.E. Co.) as a suitable material. A plastic such as Lexan inherently retains it memory that is even if the tab should be depressed over a prolonged period such as by improper registration of the locking tooth in a cap notch, the tab would tend to return completely to its normal intended condition rather than be deformed in the improper position.

While Lexan has proven to be a successful material for use with closure of the above patent, materials such as Lexan have the disadvantage of being relatively expensive. It would, therefore, be desirable to provide a safety closure system having the advantages of the above noted patent yet capable of using more economical materials such as, for example, lower cost polpropylenes.

SUMMARY OF THE INVENTION

An object of this invention is to provide a safety closure system particularly of the type disclosed in U.S. Pat. No. 3,744,655 which is capable of using low cost materials.

A further object of this invention is to provide such a safety closure which incorporates means for assuring proper orientation of the ring locking means with respect to the cap locking means so that it is not necessary to use a memory retaining material.

In accordance with this invention a safety closure system is provided which includes a cap movably engaged with a neck of a container and with a locking ring mounted on the container to prevent accidental or undesired removal of the cap by provision of locking means on the ring selectively engaging complementary locking means on the cap. A characteristic of the invention is that both the cap and locking ring contain positioning means to orient the cap locking means in the proper position with respect to the ring locking means. The positioning means are arranged so that when the cap positioning means contacts the locking ring positioning means both the cap and locking ring move jointly as a unit in the locking direction of the cap. This is accomplished by mounting the locking ring on the neck for unidirectional movement. Accordingly, the cap may be rotated downwardly on the container neck such as by the use of complementary threaded means, and the locking ring will rotate therewith in this closing direction with the ring locking means properly engaged in the cap locking means. Since the ring is mounted for only one directional movement the cap cannot be rotated in the reverse direction until its locking means is disengaged from the ring locking means.

In a preferred form of this invention the means for mounting the ring for unidirectional movement on the container neck includes spaced sets of ratchet teeth on the container neck which engage complementary ratchet teeth on the inner surface of the ring. The positioning means includes a pair of stop members or lugs on the ring engaged by a pair of camming surfaces on the cap so positioned that when the abutting faces of the camming surfaces contact the stop members the ring locking means, such as a locking tooth, is properly positioned with respect to the cap locking means, such as a respective notch in the cap.

THE DRAWINGS

DETAILED DESCRIPTIOn

The present invention is directed to a safety closure system which operates along the principles of U.S. Pat. No. 3,744,655. Accordingly, the details of that patent are incorporated herein by reference thereto. It is to be noted, for example, that although a number of embodiments are illustrated in that patent the following description is directed to only one such embodiment but that the concepts of this invention may be practiced with embodiments other than the specifically illustrated embodiment.

Figure 14:
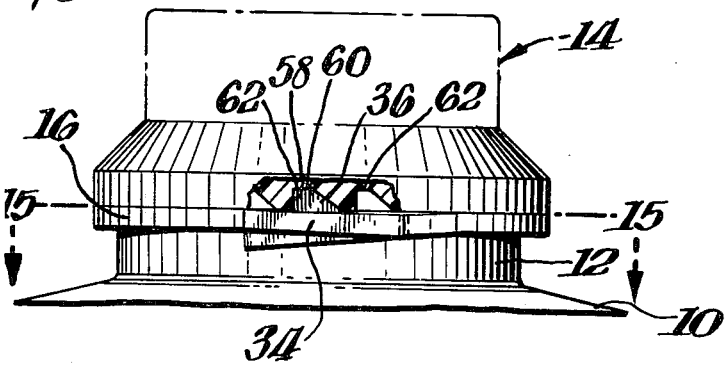
FIG. 14 is a side elevation view partly broken away of the assembled closure system.

As shown in FIG. 14, the safety closure system includes a container 10 having a neck 12 upon which is detachably mounted cap 14 locked against accidental or undesired opening by means of a locking ring 16.

Figure 2:
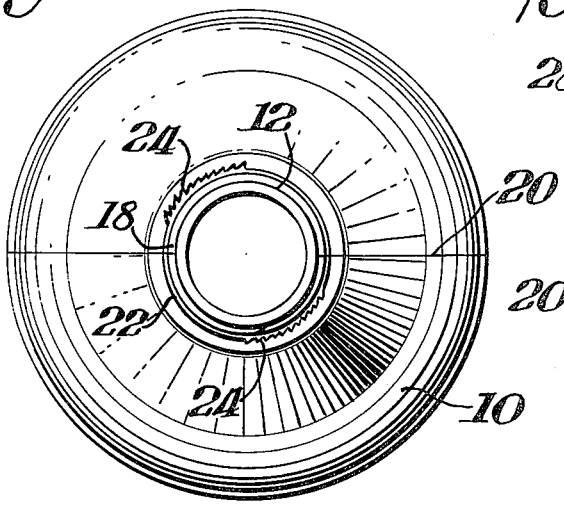
FIG. 2 is a top plan view of the container shown in FIG. 1.
Figure 3:
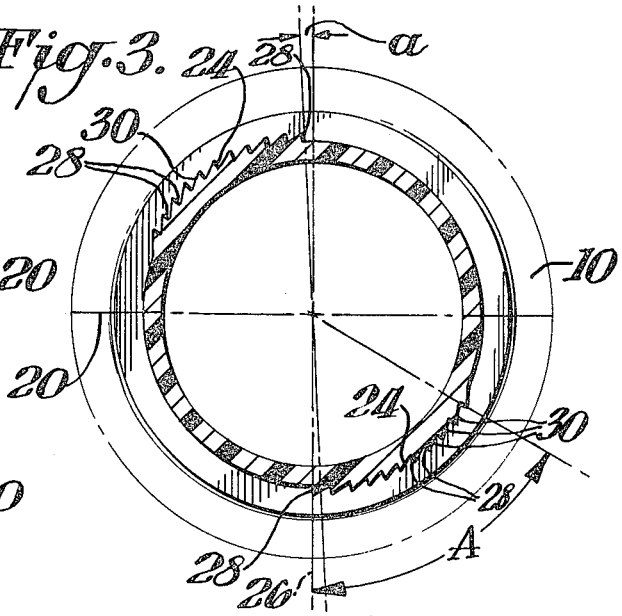
FIG. 3 is a cross-sectional view taken through FIG. 1 along the line 3—3.
Figure 1:
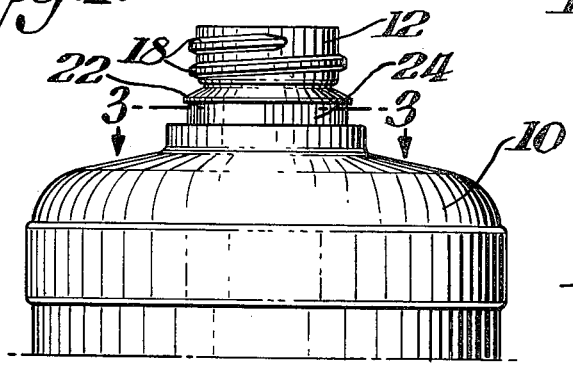
FIG. 1 is a front elevation view of a novel container in accordance with this invention.
Figure 8:
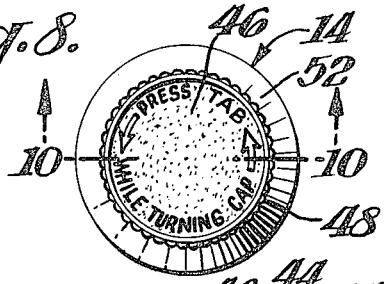
FIG. 8 is a top plan view of the cap shown in FIG. 7.
Figure 7:
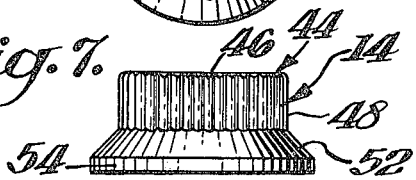
FIG. 7 is a side elevation view of a cap utilized in the closure system of this invention.

FIGS. 1-3 show the details of container 10. As indicated therein, neck 12 has external threads 18. Container 10 is molded into desired shape as indicated by mold parting line 20 of FIG. 2. Below the threaded region, neck 12 includes a retention bead 22 and below bead 22 is mounting means 24. Mounting means 24 forms an important feature of the invention as later described. As illustrated in FIGS. 2–3, the mounting means are provided in two sets and are formed with one-way ratchet teeth and are arranged in a particular relative position with respect to each other. In this regard as shown in FIG. 3, the container neck may be considered as being divided into four quadrants which are defined by parting line 20 and imaginary perpendicular bisecting line 26. Each set of teeth 24 is disposed wholly within opposite quadrants. The individual teeth are each formed with an abutting face 28 and a camming face 30 at any desirable angle. For example, in the illustrated embodiment the angle between faces 28, 30 is 60°. Correspondingly, to prevent undercuts from being formed each segment 24 is disposed over an arc substantially equal to that angle. Thus where the angle between faces 28 and 30 is 60° the entire set of teeth of each segment is disposed in an arc at angle A of 60°.

This arrangement of the arc segment being substantially equal to the tooth angle is particularly important to assure the maximum number of teeth formed in each segment without any undercuts and thus avoid problems attendant with undercuts. For example, if a slight undercut were formed by the teeth this would cause distortion in ejecting the parts from the mold and if a large undercut were formed, this might prevent ejection of the parts.

Another significant feature in the sets of teeth 24 is that first abutting face 28 in one of the segments is displaced away from quadrant line 26 by agle *a* so that the distance of face 28 from line 26 is less than the length of a tooth and peferably ½ the length. The corresponding face 28 of the opposite set, however, is disposed at quadrant line 26. Thus one segment 24 is displaced or offset by ½ the length of a tooth from being exactly diametrically opposite the other segment.

Additionally, the last face 30 of each set is disposed generally perpendicular to parting line 20. This offset displacement of the sets of ratchet teeth 24 assures a positive locking action which, as later described, prevents the locking ring 16 from rotating in the unscrewing direction of cap 14 and thus the ratchet teeth permit relative rotation of the locking ring 16 in only one direction, namely, the closing direction of the cap.

Figure 5:
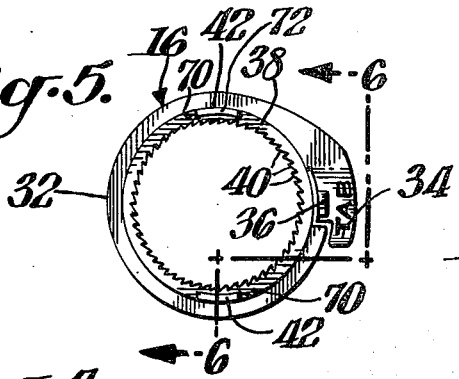
FIG. 5 is a top plan view of the locking ring shown in FIG. 4.
Figure 4:
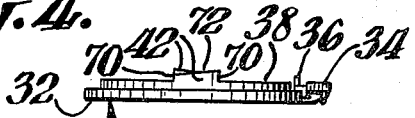
FIG. 4 is a side elevation view of a locking ring in accordance with this invention.
Figure 6:
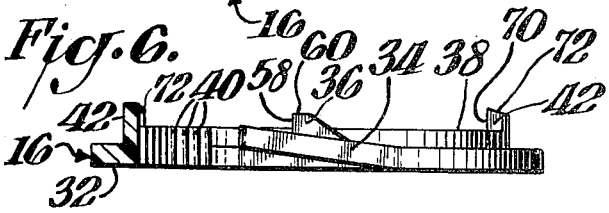
FIG. 6 is a cross-sectional view taken through FIG. 5 along the line 6—6.

FIGS. 4–6 illustrate the details of locking ring 16. As illustrated therein, ring 16 includes a annular body 32 having an offset hinged tab 34 at its outer surface with a locking tooth 36. Body 32 further includes an upstanding annular shoulder 38. The inner surface of body 32 is provided with ratchet teeth 40 which are shaped complementary to ratchet teeth 24 of neck 12. Thus when in place on neck 12 ring 16 would be mounted for unidirectional movement as previously noted. Mounted on the top of shoulder 38 is a pair of diametrically opposed stop members or lugs 42. Lugs 42 have a smooth inner surface so as not to cause any interference with retention bead 22 of neck 12.

Figure 15:
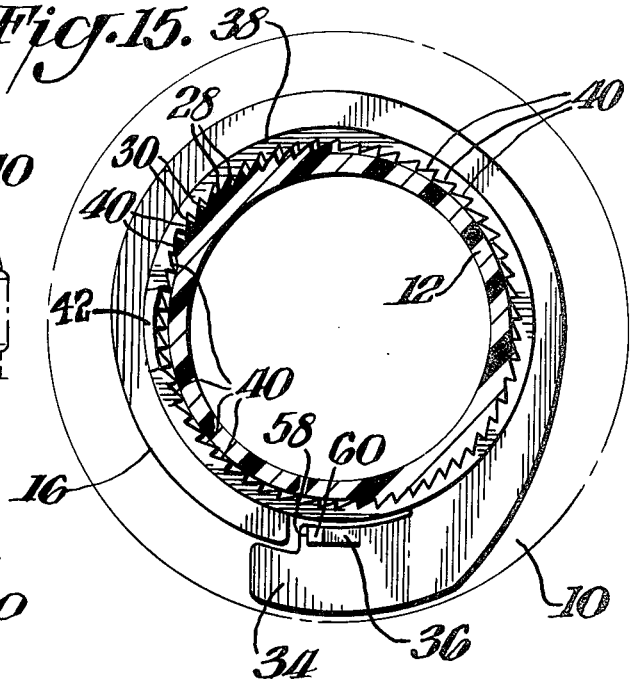
FIG. 15 is a cross-sectional view taken through FIG. 14 along the line 15—15.

In accordance with this invention the inner diameter of locking ring 16 as defined by the distance between the apices of diametrically opposed teeth 40 is substantially the same as the outer diameter of neck 12 as defined by diametrically opposed root portions of teeth 24. This equal nominal diameters is particularly advantageous is assuring a secure locking action of the ring on the neck when it is mounted in place. This locking action is best illustrated in FIG. 15. As shown therein because the teeth 24 of one segment are displaced or offset by less than a tooth length from being diametrically opposed to the other segment 24, it is impossible for teeth 40 to be precisely engaged with both segments 24 of neck 12 at the same time. Accordingly, as illustrated in FIG. 15, when there is a proper engagement of teeth 40 with respect to one segment 24 (e.g. lower portion of FIG. 15) teeth 40 are mounted on the slanted camming face 30 of the opposite segment. Moreover, since the ring and neck nominally have the same diameter, the attempted rotation counterclockwise or in the unscrewing direction of cap 14 causes the slanting faces 30 of the disengaged teeth to pull teeth 40 inwardly into an even better lock with regard to the engaged teeth at the lower portion illustrated in FIG. 15. In fact ring 16 is even slightly distorted to a slightly oval shape as illustrated in FIG. 15 by such reverse rotation. Thus by offsetting the segments 24 and by using the same nominal diameters for both the neck and ring there is greater assurement that the ring will be prevented against rotating in the opening direction of cap 14.

FIGS. 7–10 illustrate the details of cap 14. As indicated therein cap 14 includes a body member 44 having a top wall 46 for closing the discharge opening in neck 12. A cylindrical side wall 48 depends from top wall 46 and may be knurled, grooved or include other structure to facilitate gripping thereof by the user. The inner surface of wall 48 is provided with threaded means 50 for threadably engaging complementary threaded means 18 on neck 12. Side wall 48 terminates in an outwardly extending peripheral skirt 52 which is frusto-conically shaped and which in turn terminates in a cylindrical wall portion 54. The inner surface of cylindrical wall portion 54 is formed with notches 56 of the type illustrated and described in U.S. Pat. No. 3,744,655. Locking tooth 36 on ring 16 is complementary shaped with respect to notches 56 so that tooth 36 is engaged in a corresponding notch of the cap when the cap is mounted in place and the abutting or locking face 58 of tooth 36 prevents rotation of cap 14 in its unlocking direction. The cap may be removed by depressing tab 34 of locking ring 16 to disengage tooth 36 from its corresponding notch 56 as also described in the above noted patent.

Figure 10:
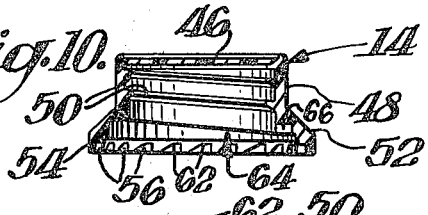
FIG. 10 is a cross-sectional view taken through FIG. 8 along the line 10—10.
Figure 9:
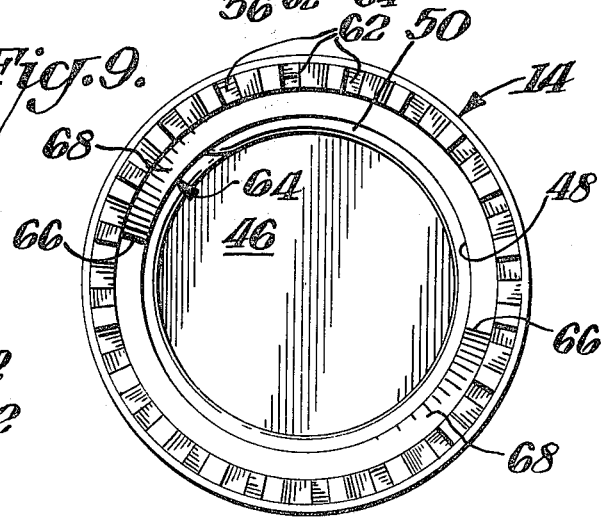
FIG. 9 is a bottom plan view of the cap shown in FIGS. 7–8.
Figure 13:
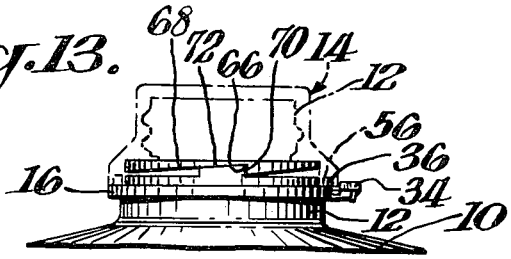

This invention incorporates means to assure that tooth 36 will be properly registered in a corresponding notch 56 with the apex 60 of tooth 36 positioned against a corresponding apex 62 in notch 56. This positioning means is best illustrated in FIGS. 9, 10 and 13 and operates in cooperation with lugs or stop members 42. The cap positioning means includes a pair of cam members 64 molded in cap 14 with each cam member 64 having a vertical contacting surface 66 with an upwardly sloping cam surface 68. As shown in FIGS. 9–10, cams 64 are disposed above and radially inwardly of notches 56. As later described each contacting surface is disposed for contacting a corresponding vertical contact surface 70 of lug 42. When these contacting surfaces abut each other locking tooth 36 is properly positioned with respect to a corresponding notch 56 so that apices 60, 62 are properly orientated as illustrated in FIGS. 13–14.

Figure 11:
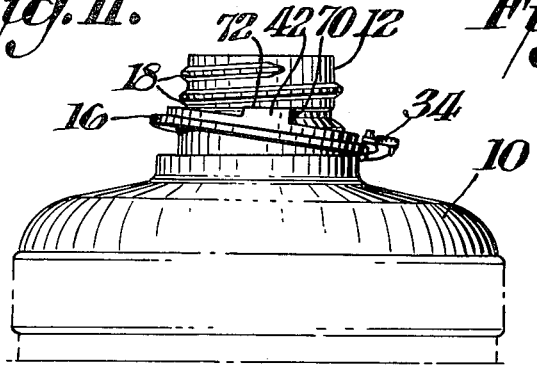
FIG. 11 is a side elevation view showing the locking ring loosely mounted on the container in a preliminary stage of assembly.

FIGS. 11–14 illustrate a manner of assembling the closure system. As illustrated in FIG. 11, the first step in the assembly procedure is to loosely place ring 16 on neck 12. This loose placement will result in the ring being arranged in any haphazard fashion and it will ultimately be necessary for the ring to be flattened or properly horizontally disposed for proper engagement with the neck.

Figure 12:
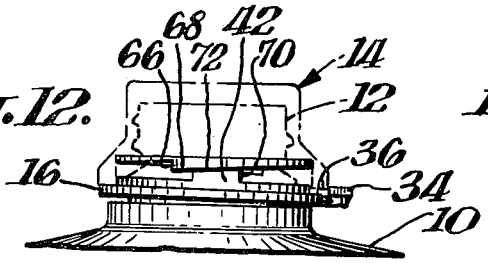
FIGS. 12–13 are side elevation views showing subsequent stages of assembly with the cap illustrated in phantom.

FIG. 12 illustrates a further step in the assembly operation. As indicated therein, cap 14 (shown in phantom) is placed on top of neck 12 and rotated by threaded engagement of complementary threaded means 18, 50. Lugs 42 each have a top wall 72 slanted downwardly away from contact face 70. Camming surface 68 rides oer the slanted top wall 72 of lug 42 as the cap continues to be rotated downwardly. Since cap 14 is maintained in its proper horizontal and vertical orientation with respect to neck 12 by means of threaded engagement therewith, the camming means 64 pushes downwardly against stops or lugs 42 to level ring 16 into its proper orientation with respect to neck 12. Continued rotation of cap 14 eventually pushes ring 16 downwardly so that teeth 40 of ring 16 engage teeth segments 24 of neck 12. As illustrated in FIG. 13, contact face 66 of camming means 64 ultimately abuts against contact face 70 of stop or lug 42 at which time tooth 36 becomes properly registered in a corresponding notch 56 (FIG. 14). Continued tightening or closing rotation of cap 14 causes cap 14 and locking ring 16 to move jointly as a unit because of the interengagement of the positioning means. Rotation of locking ring 16 in the closing direction is permitted by the unidirectional mounting of ring 16 on neck 12. Rotation continues until cap 14 is securely mounted in place. As previously described if an attempt is made to remove the cap without depressing tab 34, this movement is prevented by the engagement of locking tooth 36 in a corresponding notch 56 and rotation of the locking ring is in turn prevented by the firm mounting illustrated in and described with respect to FIG. 15. When, however, tab 34 is depressed locking tooth 36 is withdrawn from its notch 56 and cap 14 may be rotated in a counterclockwise direction with camming face 68 riding over inclined top wall 72 until the cap is removed. During this reverse or opening rotation of cap 14, ring 16 of course remains stationarily mounted on neck 12. After a sufficient amount of contents has been dispensed from container 10, cap 14 is replaced in a conventional manner by screwing the cap on neck 12 whereupon abutting faces 66 and 70 will ultimately contact and tooth 36 will again be properly registered as previously described.

Although FIGS. 11–14 illustrate a manner of assembly wherein the ring 16 is placed on neck 12 in a separate operation prior to the placement of cap 14, it is of course possible to assemble the closure system in other manner. Thus, for example, ring 16 and cap 14 may be preassembled and mounted on the neck as a unit by utilization, for example, of gripping fingers which hold the ring and cap together.

As previously described, the instant invention effectively assures that there will be a proper positioning of the locking tooth with respect to a corresponding locking notch so as to permit the use in the locking system of cheaper material such as polypropylenes which are not noted for memory characteristics. Although the invention has been described with particular respect to the type of closure system of U.S. Pat. No. 3,744,655, the concepts of the invention may be employed in other types of closure systems wherein a cap is removably mounted on a container neck and wherein the cap incorporates locking elements which interengage corresponding locking elements on a locking ring mounted on the neck so that the cap may not be removed unless there is an inactivation of the cap and ring locking means. Accordingly, the above invention is not intended to be limited to the above description but may be practiced as defined in the appended claims.

What is claimed is:

1. A safety closure system comprising, in combination, a container having a neck with an opening through which the container contents are dispensed, a cap removably covering said container neck opening, engaging means on said cap engaging complementary engaging means on said container neck, a locking ring, mounting means on said locking ring and said neck mounting said ring to said container neck, locking means on said locking ring, complementary locking means on said cap for selective engagement with said locking means on said ring, inactivating means associated with one of said locking means for disengaging said ring locking means from said cap locking means whereby said cap may be removed from the container neck only when said cap locking means is disengaged from said ring locking means, first positioning means on said locking ring, second positioning means on said cap for contacting said first positioning means while said cap is being inserted on said neck to orient said ring locking means for proper positioning with respect to said cap locking means to assure proper engagement therewith, and said mounting means being structured for one directional movement of said ring with respect to said container neck to permit said cap and said ring to move jointly in a closing direction when said cap is inserted over said neck and to prevent an opposite opening direction of movement of said ring with respect to said container neck.

2. The system of claim 1 wherein said mounting means on said locking ring comprises a set of ratchet teeth uniformly disposed along the inner surface of said ring, a set of complementary shaped ratchet teeth on said neck for engaging said ring ratchet teeth, said first positioning means comprising at least one lug on said ring having a vertically disposed contact face, said second positioning means comprising at least one cam means on said cap including a vertical contact wall for abutting against said lug contact face, and said cam means further including an upwardly inclined lower surface extending away from its contact wall.

3. The system of claim 2 wherein neck mounting means further includes a second set of ratchet teeth mounted opposite the first set but displaced from a diametrically opposed mounting by a distance of less than the length of one ratchet tooth, and the inner diameter of said ring as defined by its teeth points being nominally the same as the outer diameter of said neck as defined by its teeth roots.

4. The system of claim 3 wherein said container includes a molded parting line, each set of ratchet teeth on said neck being confined totally within a quadrant as defined by said parting line and an imaginary line perpendicularly bisecting said parting line, and each set being disposed in an arc at an angle substantially equal to the angle of each of its ratchet teeth.

5. The system of claim 4 wherein each of said ratchet teeth in each of said sets includes a short contact face and a longer face connected thereto to define said angle, the first contact face in one of said sets being displaced from said imaginary line by a distance equal to one-half the length of a tooth, the first contact face in the opposite set being disposed along said imaginary line, and each remote longer face in each set being substantially perpendicular to said parting line.

6. The system of claim 2 wherein said first positioning means includes a second lug on said ring diametrically opposed to the first lug, said second lug having a general vertical contact face, each of said lugs having a slanted top wall which extends downwardly away from its contact face, said second positioning means including a second cam means on said cap diametrically opposed to the first cam means, said second cam means including a vertical wall and an upwardly inclined lower surface, and each of the upwardly inclined lower surfaces of the first and second cam means slanting upwardly from its contact wall toward the contact wall of its other cam means.

7. The system of claim 6 wherein said cap includes an internally threaded side wall terminating in an outwardly extending peripheral skirt, the internal threads of said side wall comprising said engaging means, said neck being correspondingly threaded to comprise said complementary engaging means, said cap locking means comprising a plurality of uniformly spaced notches disposed on the inner surface of said skirt, said cam means being disposed above and radially inwardly of said notches, said ring locking means comprising at least one locking tooth shaped to fit within one of said cap notches, said inactivating means comprising a hinged tab mounted to and offset from said ring, and said at least one locking tooth being mounted on the upper surface of said tab.

8. The system of claim 7 wherein said container has a molded parting line, said neck mounting means including a second set of ratchet teeth, each of the sets of ratchet teeth on said neck being confined totally within opposite quadrants as defined by said parting line and an imaginary line perpendicularly bisecting said parting line, the leading face in the first tooth of one of said sets being displaced from said imaginary line by a distance less than the length of a tooth in said set, the leading face of the opposite set being disposed along said imaginary line, the trailing faces in the last tooth of each set being perpendicular to said parting line, each set being disposed in an arc defined by an angle equal to the angle of adjoining sides in one of its teeth, and the inner diameter of said ring as defined by its teeth apices being nominally the same as the outer diameter of said neck as defind by its teeth roots.

9. A cap for use in a safety closure system on a container having a locking ring thereon for engaging the cap to prevent undesired removal of the cap from the container, comprising a body member, a top wall on said body member, a cylindrical side wall depending from said top wall, threaded means on the inner surface of said side wall for engaging complementary threaded means on the container, said side wall terminating in an outwardly extending peripheral skirt, locking means on said peripheral skirt for engaging complementary locking means on the ring, and positioning means comprising at least one contact member on said skirt for contacting a corresponding portion of the ring to properly orient the ring and said cap with respect to each other for assuring proper engagement of said cap locking means with the ring locking means.

10. The cap of claim 9 wherein said at least one contact member includes cam means exposed from the open lower end of said cap, said cam means including a generally vertical wall, and a slanted lower wall extending upwardly away from said vertical wall.

11. The cap of claim 10 wherein said at least one contact member further includes a second cam means disposed diametrically opposite the first cam means, each slanted lower wall extending from its vertical wall upwardly to the opposite vertical wall, said locking means comprises a plurality uniformly spaced notches peripherally around the inner wall of said skirt, each of said notches having an inwardly slanted side wall and a generally vertical wall with an apex therebetween, and said cam means being located above and radially inward of said notches.

12. A locking ring for use in a safety closure system on the neck of a container which is closed by a removable cap, comprising a ring body with an inner surface and an outer surface, mounting means on said inner surface for engaging complementary mounting means on the container neck, said ring mounting means being structured for only single directional movement of said ring around the container neck, locking means on said ring located at said outer surface for engagement with complementary locking means on the cap, inactivating means on said ring for moving said ring locking means out of locking engagement with the cap locking means, and positioning means on said ring body for orienting said ring locking means for proper registration with the cap locking means.

13. The locking ring of claim 12 wherein said mounting means comprises ratchet teeth uniformly spaced completely around said inner surface, each of said ratchet teeth comprising a relatively short abutting wall joined to a longer slanted wall with an apex therebetween.

14. The locking ring of claim 13 wherein said positioning means includes a pair of diametrically disposed lugs located along said inner surface above said ratchet teeth, and each of said lugs having a generally vertical contact face and a top wall slanted downwardly away from its contact face.

15. The locking ring of claim 13 wherein said inactivating means comprises a hinged tab extending away from said outer surface, said locking means comprising at least one upstanding locking tooth on said tab, said positioning means including a pair of upstanding lugs mounted diametrically opposite each other, said lugs being disposed along said inner surface of said ring and above said ratchet teeth, each lug being smooth along its inner surface, each of said lugs having a vertical contact face and a slanted top wall, and each of said slanted walls tapering downwardly away from its vertical contact face.

16. The locking ring of claim 12 wherein said positioning means includes at least one upstanding lug mounted on said ring body above said mounting means, and said lug having a generally vertical contact face.

17. A container for use in a safety closure system incorporating a removable cap for closing the container and a locking ring on the container for engaging the cap to prevent undesired removal of the cap from the container, comprising a container body for holding contents to be dispensed, a neck on said container and having a dispensing opening at its top for selective closing by the cap, external threaded means on said neck for engaging complementary threaded means on the cap, mounting means on said neck for engaging complementary mounting means on the ring, and said neck mounting means being structured to permit rotational movement of the ring in the screwing direction of the cap on said neck and to prevent rotational movement of the ring in the unscrewing direction.

18. The container of claim 17 wherein said mounting means includes a set of ratchet teeth disposed in an arc along a segment of said neck, each of said ratchet teeth having a relatively short abutting wall joined at an apex to a longer slanted wall.

19. The container of claim 18 wherein said mounting means includes a second set of ratchet teeth mounted displaced from a diametrically opposite mounting of the first set by the length of less than one tooth.

20. The container of claim 19 wherein said container includes a molded parting line, each of said sets of ratchet teeth being confined wholly within an opposite quadrant as defined by said parting line and an imaginary perpendicular line bisecting said parting line, and each set being disposed over an arc defined by approximately the same angle between the sides defining each tooth.

21. The container of claim 20 wherein the first tooth wall of one of said sets of teeth is disposed away from said imaginary line by a distance equal to one-half the length of a tooth, the first tooth wall of the opposite set being disposed along said imaginary line, and the last tooth wall of each set being perpendicular to said parting line.

22. The system of claim 1 wherein said mounting means on said locking ring comprises a set of ratchet teeth uniformly disposed along the inner surface of said ring, and a set of complementary shaped ratchet teeth on said neck for engaging said ring ratchet teeth.

23. The system of claim 1 wherein said first positioning means comprises at least one lug on said ring having a vertically disposed contact face, said second positioning means comprising at least one cam means on said cap including a vertical contact wall for abutting against said lug contact face, and said cam means further including an upwardly inclined lower surface extending away from its contact wall.

* * * * *